US007028655B2

(12) United States Patent
Wakao et al.

(10) Patent No.: US 7,028,655 B2
(45) Date of Patent: Apr. 18, 2006

(54) INTERNAL COMBUSTION ENGINE AND METHOD OF CONTROLLING THE SAME

(75) Inventors: Kazuhiro Wakao, Susono (JP); Kazuhiro Sakurai, Gotemba (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/917,484

(22) Filed: Aug. 13, 2004

(65) Prior Publication Data

US 2005/0051113 A1 Mar. 10, 2005

(30) Foreign Application Priority Data

Sep. 4, 2003 (JP) ..... 2003-313193

(51) Int. Cl.
*F02N 17/00* (2006.01)

(52) U.S. Cl. ..... 123/179.14; 123/1 A; 123/3

(58) Field of Classification Search ..... 123/3, 123/1 A, 179.14, 179.15, 179.16, DIG. 12
See application file for complete search history.

(56) References Cited

U.S. PATENT DOCUMENTS 3,915,125 A * 10/1975 Henkel et al. ..... 123/3
3,963,000 A * 6/1976 Kosaka et al. ..... 123/3
4,125,090 A * 11/1978 Masunaga et al. ..... 123/3
4,520,764 A * 6/1985 Ozawa et al. ..... 123/3
5,785,136 A * 7/1998 Falkenmayer et al. ..... 180/65.2
6,655,130 B1 * 12/2003 Kirwan et al. ..... 60/284

FOREIGN PATENT DOCUMENTS

JP A 2001-241365 9/2001

* cited by examiner

*Primary Examiner*—Mahmoud Gimie
(74) *Attorney, Agent, or Firm*—Oliff & Berridge, PLC

(57) ABSTRACT

The internal combustion engine includes a reformer for reforming a fuel air mixture of a predetermined fuel and air to produce a reformed fuel, a bypass pipe for supplying air to the reformer, an on-off valve provided in the bypass pipe, and an ECU. The ECU makes the on-off valve open to start a fuel reforming operation in the reformer when a pressure at a position downstream of the on-off valve is lower than a pressure at a position upstream of the on-off valve.

10 Claims, 7 Drawing Sheets

INTERNAL COMBUSTION ENGINE AND METHOD OF CONTROLLING THE SAME

This application claims priority from Japanese Patent Application No. 2003-313193 filed Sep. 4, 2003, which is incorporated hereinto by reference.

BACKGROUND OF THE INVENTION

1. Field of the Invention

The present invention relates to an internal combustion engine for generating power by combustion of a fuel air mixture of a reformed fuel produced by a reformer and air in a combustion chamber, and a method of controlling the same.

2. Description of the Related Art

For example, Japanese Patent Application Laid-open No. 2001-241365 discloses an internal combustion engine for generating power by combustion of a fuel air mixture of a reformed fuel produced by a reformer and air in a combustion chamber. The reformer of the internal combustion engine reforms a fuel air mixture of a fuel and air to produce the reformed fuel containing predetermined fuel components (for example, CO and $H_2$). Also, Japanese Patent Application Laid-open No. 9-021362(1997) discloses an internal combustion engine with a reformer. The reformer has an air intake line including a throttle valve and a reforming air supply line branched from the air intake line at a point upstream from the throttle valve. Air is supplied to the reformer via the reforming air supply line.

In the conventional internal combustion engine, a supply of air to the reformer is started when a catalyst temperature in the reformer exceeds a predetermined value (see Japanese Patent Application Laid-open No. 9-021362(1997)). Accordingly, a sufficient amount of air may not be supplied to the reformer at a beginning of a fuel reforming operation, so that the conventional internal combustion engine may not be favorably started.

SUMMARY OF THE INVENTION

The present invention is directed to overcome one or more of the problems as set forth above.

One aspect of the present invention relates to an internal combustion engine generating power by combustion of a fuel air mixture of a reformed fuel and air in a combustion chamber. The internal combustion engine comprises: a reformer for producing the reformed fuel by reforming a fuel air mixture of a predetermined fuel and air; a reforming air supply line for supplying air to the reformer; a valve provided in the reforming air supply line; and control means for making the valve open when a pressure at a predetermined position downstream of the valve is lower than a pressure at a predetermined position upstream of the valve.

Another aspect of the present invention relates to a method of controlling an internal combustion engine for generating power by combustion of a fuel air mixture of a reformed fuel and air in a combustion chamber, the internal combustion engine comprising: a reformer for producing the reformed fuel by reforming a fuel air mixture of a predetermined fuel and air; a reforming air supply line for supplying air to the reformer; and a valve provided in the reforming air supply line. The method comprises the step of making the valve open when a pressure at a predetermined position downstream of the valve is lower than a pressure at a predetermined position upstream of the valve.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
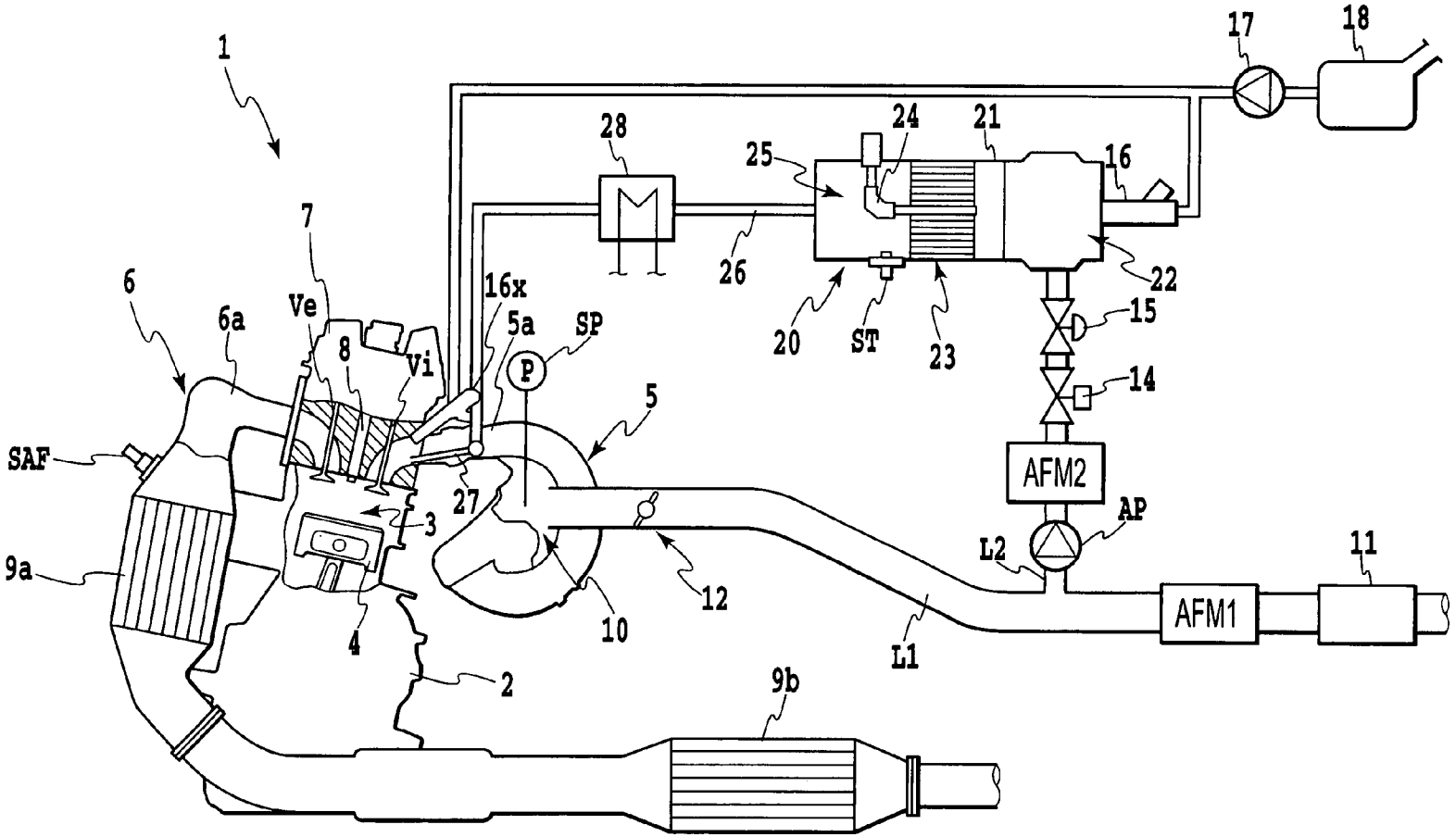
FIG. 1 is a schematic illustration of an internal combustion engine according to a first embodiment of the present invention.

The internal combustion engine according to the present invention includes a reformer for producing a reformed fuel by reforming a fuel air mixture of a predetermined fuel and air and a valve provided in a reforming air supply line for supplying air to the reformer. The valve is made to open by control means when a pressure at a predetermined position downstream the valve is lower than a pressure at another predetermined position upstream of the valve. That is, in this internal combustion engine, the valve is made to open after the pressure at the position downstream of the valve has sufficiently lowered or the pressure at the position upstream of the valve has sufficiently risen while closing the valve in the reforming air supply line, so that a sufficient amount of air can be supplied to the reformer. Thus, according to the present invention, it is possible to perform a fuel reforming operation in a stable and favorable manner immediately following the start of the supply of air to the reformer so as to start the fuel reforming operation. Accordingly, the reformed fuel can be used for starting the internal combustion engine, since a desired amount of the reformed fuel can be obtain in the reformer from the beginning.

Preferably, the control means makes the valve close prior to a start of the fuel reforming operation in the reformer, and makes the valve open when the pressure at the position downstream of the valve becomes lower than a predetermined value after a cranking of the internal combustion engine.

Preferably, the internal combustion engine further includes a flow control valve provided in the reforming air supply line for adjusting an amount of air to be supplied to the reformer. In this case, the control means starts a setting of an opening degree of the flow control valve prior to an opening of the valve in the reforming air supply line.

By starting the setting of the opening degree of the flow control valve prior to opening the valve in the reforming air supply line, it is possible to precisely set the amount of air to be supplied to the reformer immediately following the start of the supply of air to the reformer. Thus, it is possible to favorably perform the fuel reforming operation in a stable manner to obtain a desired amount of the reformed fuel.

Preferably, the internal combustion engine further includes an air intake line having a throttle valve and connected to the combustion chamber, and the reforming air supply line is branched from the air intake line at a point upstream of the throttle valve. In this case, the control means starts the fuel reforming operation in the reformer after setting an opening degree of the throttle valve at a minimum.

Preferably, the internal combustion engine is combined with an electric motor to constitute a hybrid power system. In this case, the control means makes the valve close prior to the start of the fuel reforming operation in the reformer, and makes the valve open when the pressure at the position downstream of the valve becomes lower than a predetermined value after a motoring to rotate a shaft of the internal combustion engine by the electric motor.

Preferred embodiments according to the present invention will now be described with reference to drawings.

(First Embodiment)

FIG. 1 is a schematic illustration of an internal combustion engine according to a first embodiment of the present invention. The internal combustion engine 1 shown in FIG. 1 is suitably used as a power unit of a vehicle. The internal combustion engine 1 generates power by combustion of a fuel air mixture containing a fuel component in combustion chambers 3 formed in an cylinder block 2 to reciprocate a piston 4 in the respective combustion chambers 3. While only one cylinder is illustrated in FIG. 1, the internal combustion engine 1 of this embodiment is preferably configured as a multi-cylinder engine (for example, a four-cylinder engine).

An intake port of each combustion chamber 3 is connected to an intake pipe 5*a* constituting an intake manifold 5, while an exhaust port of each combustion chamber 3 is connected to an exhaust pipe 6*a* constituting an exhaust manifold 6. Also, in a cylinder head of the internal combustion engine 1, an intake valve Vi for opening and closing the intake port and an exhaust valves Ve for opening and closing the exhaust port are disposed with respect to each of the combustion chambers 3. The intake valves Vi and the exhaust valves Ve are operated by a valve operating mechanism 7 preferably having a variable valve-timing function. Further, in the cylinder head of the internal combustion engine 1, an ignition plug 8 is disposed with respect to each of the combustion chambers 3. Also, the exhaust manifold 6 is provided with an exhaust gas air-fuel ratio sensor ($O_2$ sensor) SAF for detecting an air-fuel ratio of an exhaust gas from the respective combustion chambers 3. The exhaust manifold 6 is connected to a front-stage catalyst unit 9*a* and a rear-stage catalyst unit 9*b*.

As shown in FIG. 1, the intake manifold 5 (respective intake pipes 5*a*) is connected to a surge tank 10, and the surge tank 10 is connected to an air supply pipe L1. Theses intake manifold 5, surge tank 10 and air supply pipe L1 constitute an air intake system of the internal combustion engine 1. The air supply pipe L1 is connected to an air inlet (not shown) via an air cleaner 11. A throttle valve (an electronic throttle valve in this embodiment) 12 is incorporated in the air supply pipe L1 between the surge tank 10 and the air cleaner 11. Also, the surge tank 10 is provided with a pressure sensor SP for detecting an internal pressure of the surge tank 10. In this case, the internal pressure of the surge tank 10 is substantially equal to a pressure in the vicinity of the intake port of the respective combustion chambers 3 and the internal pressure of the reformer 20 (a pressure at a position downstream of an on-off valve described later). In addition, a position of the pressure sensor SP is not limited to the surge tank 10 but may be optionally selected on the downstream side of the throttle valve 12.

Further, the air supply pipe L1 is provided with a first air flow meter AFM1 between the air cleaner 11 and the throttle valve 12. A bypass pipe (a reforming air supply line) L2 is branched from the air supply pipe L1 at a branch point BP positioned between the throttle valve 12 and the first air flow meter AFM1 (upstream of the throttle valve 12). The bypass pipe L2 includes, in the midway thereof, an air pump AP, a second air flow meter AFM2, a flow control valve 14 and an on-off valve or shut off valve 15 in this order from the branch point BP. A front end (an end opposite to the branch point BP) of the bypass pipe L2 is connected to the reformer 20. In addition, the arrangement order of the air pump AP, the second air flow meter AFM2, the flow control valve 14 and the on-off valve 15 is not limitative but other arrangement orders may be optionally adopted. It is essential only that the air pump AP is disposed upstream of the flow control valve 14 and the on-off valve 15.

The reformer 20 has a generally tubular body 21 closed at opposite ends thereof. The body 21 includes an air-fuel mixing section 22 and a reforming reaction section 23 adjacent the air-fuel mixing section 22 in the interior thereof. A fuel injection valve 16 is connected to the air-fuel mixing section 22 in addition to the bypass pipe L2. The fuel injection valve 16 is connected to a fuel tank 18 via a fuel pump 17 and is capable of injecting a hydrocarbon fuel such as gasoline into the air-fuel mixing section 22. Also, a reforming catalyst, for example, carrying rhodium on zirconium oxide is disposed in the reforming reaction section 23. Moreover, the reforming reaction section 23 is provided with a preheater 24 for preheating the reforming catalyst.

In the interior of the main body 21, a reformed fuel distributing chamber 25 is defined on the downstream side of the reforming reaction section 23. A plurality of reformed fuel supply pipes 26 corresponding to the number of the combustion chambers 3 in the engine 1 are connected to the reformed fuel distributing chamber 25. A fuel supply nozzle 27 is attached to a front end of the respective reformed fuel supply pipes 26. The fuel supply nozzle 27 is disposed in the vicinity of the intake port of the corresponding combustion chamber 3. Also, the internal combustion engine 1 has a heat exchanger 28 for cooling the reformed fuel in the respective reformed fuel supply pipes 26. As a refrigeration medium for the heat exchanger 28, an engine coolant may be used. Further, the reformed fuel distributing chamber 25 of the reformer 20 is provided with a temperature sensor ST. In this embodiment, the temperature sensor ST is attached to the main body 21 to be positioned on the downstream side of the reforming reaction section 23 so that the temperature of the reformed fuel flowing out from the reforming reaction section 23 can be detected. In addition, instead of providing the reformed fuel supply pipes 26 in every combustion chambers 3, a single reformed fuel supply pipe may be connected to the reformed fuel distributing chamber 25, one end of the single reformed fuel supply pipe being branched into the respective combustion chambers 3 in the interior of the intake manifold 5 on the downstream side of the heat exchanger 28.

Further, the internal combustion engine 1 has a plurality of fuel injection valves 16*x*. Each intake pipe 5*a* is provided with one fuel injection valve 16*x* so that the fuel (non-reformed fuel, for example, gasoline) conveyed by the fuel pump 17 is injected from the fuel injection valve 16*x* into the respective intake pipes 5*a*. Accordingly, in the internal combustion engine 1, it is possible to obtain the power under the condition in which the reformer 20 is operated or the supply of air and the fuel to the reformer 20 is stopped. The fuel injection valve 16*x* may be of a type injecting the fuel directly into the corresponding combustion chamber 3.

Figure 2:
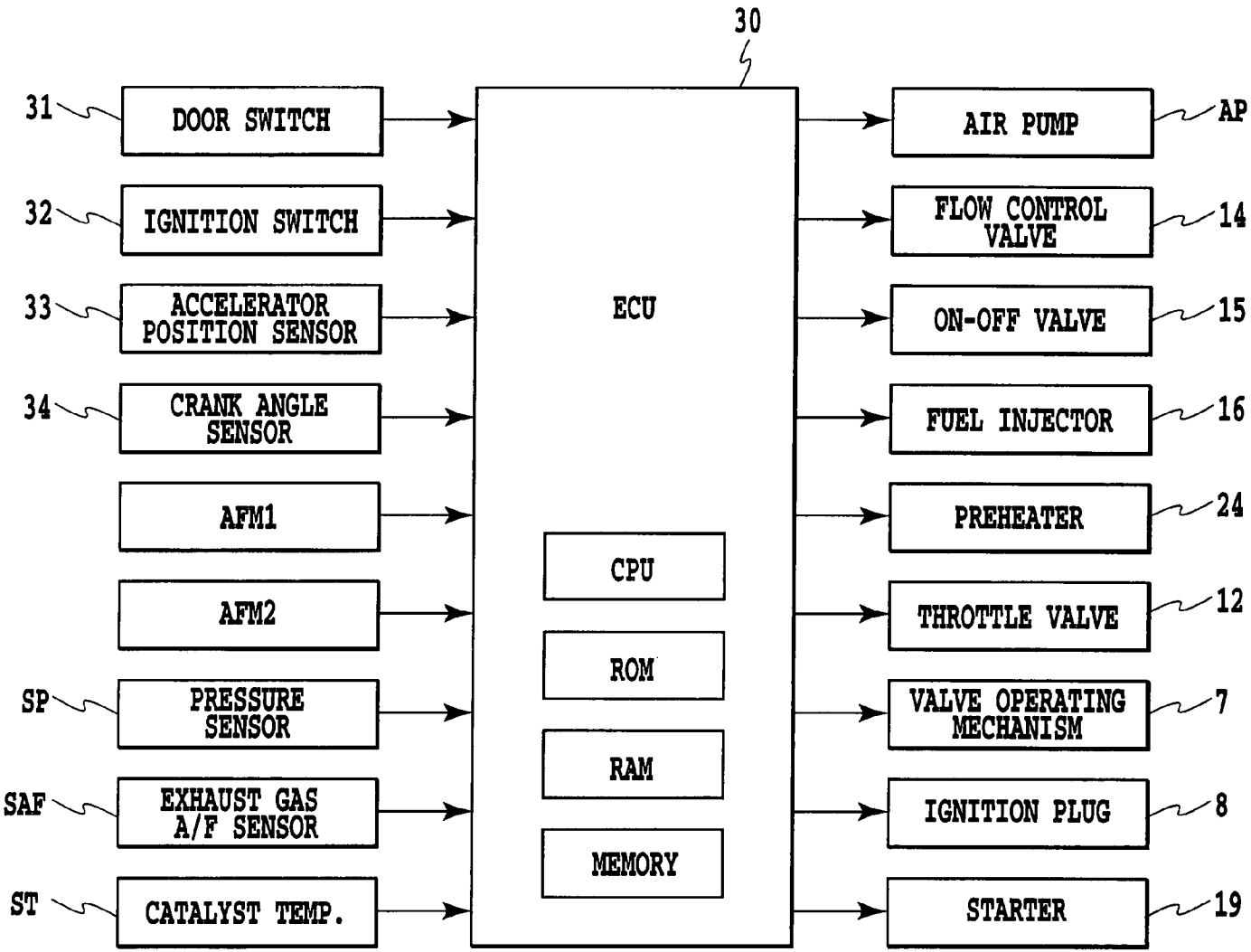
FIG. 2 is a control block diagram of the internal combustion engine of FIG. 1.

FIG. 2 is a control block diagram of the internal combustion engine 1. As shown in FIG. 2, the internal combustion engine 1 has an electronic control unit (hereinafter referred to as "ECU") 30 serving as control means. The ECU 30 includes CPU, ROM, RAM, input/output interfaces and memories (storage devices) for memorizing various information and maps. To the ECU 30 (input/output interfaces thereof), the above-mentioned valve operating mechanism 7, the ignition plugs (igniter) 8, the throttle valve 12, the flow control valve 14, the on-off valve 15, the fuel injection valves 16, 16*x*, the air pump AP, a starter 19 and the like are connected via control circuits or the like.

To the input/output interfaces of the ECU 30, various sensors, i.e., the above-mentioned air flow meters AFM1, AFM2, the pressure sensor SP, the exhaust gas air-fuel ratio sensor SAF, the temperature sensor ST and the like are connected. The first air flow meter AFM1 detects a total amount of air (a total amount of air supplied to all the combustion chambers 3) taken into the air supply pipe L1 from the air inlet, and provides the ECU 30 with a signal indicating the detected value. Also, the pressure sensor SP, the exhaust gas air-fuel ratio sensor SAF and the temperature sensor ST provides the ECU 30 with signals indicating the detected values respectively.

Moreover, a door switch 31, an ignition switch 32, an accelerator position sensor 33, a crank angle sensor 34 and the like are connected to the input/output interfaces of the ECU 30. The door switch 31 detects the opening/closing of a door of the vehicle to which the internal combustion engine 1 is applied. The accelerator position sensor 33 provides the ECU 30 with a signal indicating an operating amount of an accelerator pedal (not shown). The crank angle sensor 34 provides the ECU 30 with a signal indicating a crank angle of the internal combustion engine 1. The ECU 30 controls an opening degree of the throttle valve 12 and the flow control valve 14, a fuel injection rate through the fuel injection valve 16 or 16*x*, the ignition timing of the ignition plugs 8, the on-off timing of the intake valve Vi and the exhaust valve Ve and the like based on signals from the air flow meters AFM1, AFM2, the accelerator position sensor 33, the crank angle sensor 34 and the like.

Upon operating the above-mentioned internal combustion engine 1, air is introduced into the air-fuel mixing section 22 of the reformer 20 via the bypass pipe L2 including the air pump AP, the flow control valve 14 controlled by the ECU 30. Also, the fuel such as gasoline is ejected from the fuel injection valve 16 controlled by the ECU 30 into the air-fuel mixing section 22. The fuel such as gasoline gasifies in the air-fuel mixing section 22 and mixes with air supplied from the bypass pipe L2, so that a fuel air mixture flows into the reforming reaction section 23. In the reforming reaction section 23, the hydrocarbon fuel and air are reacted each other by the reforming catalyst, so that the partially oxidation reaction represented by the following equation (1) is proceeded.

$$C_mH_n + \frac{m}{2}\cdot O_2 \rightarrow m\cdot CO + \frac{n}{2}\cdot H_2 \quad (1)$$

As the reaction of the equation (1) proceeds, the reformed fuel (reformed gas) containing CO and $H_2$ as fuel components is produced. The reformed fuel is supplied from the reformer 20 to the intake port of the respective combustion chambers 3 via the reformed fuel supply pipe 26 and the fuel supply nozzle 27. Also, air is introduced into the intake port of the respective combustion chambers 3 via the throttle valve 12 in the air supply pipe L1 of which opening degree is controlled by the ECU 30. Accordingly, the reformed fuel introduced from the reformer 20 to the respective intake port is sucked in the respective combustion chambers 3 after further being mixed with air from the throttle valve 12. When each ignition plug 8 is operated at the predetermined timing, the fuel components of CO and $H_2$ burn within the respective combustion chambers 3. As a result, the piston 4 reciprocates within the respective combustion chambers 3 so that the power can be obtained from the internal combustion engine 1.

Now, at the start-up of the internal combustion engine 1 with the above-mentioned reformer 20, an amount of air sucked into the combustion chambers 3 is generally small. Therefore, unless a countermeasure is taken, it may be difficult to supply a sufficient amount of air to the reformer 20 via the bypass pipe L2 branched from the air supply pipe L1 at a point upstream of the throttle valve 12 so as to start the fuel reforming operation in the reformer 20. Also, at the beginning of the fuel reforming operation in the reformer 20, it is essentially preferable that air is supplied to the reformer 20 when the internal pressure of the reformer 20 sufficiently is lowered (when a negative pressure is generated in the reformer 20). Further, if the air pump AP is always operated in the internal combustion engine 1, energy for driving the air pump AP is wasted.

Figure 3:
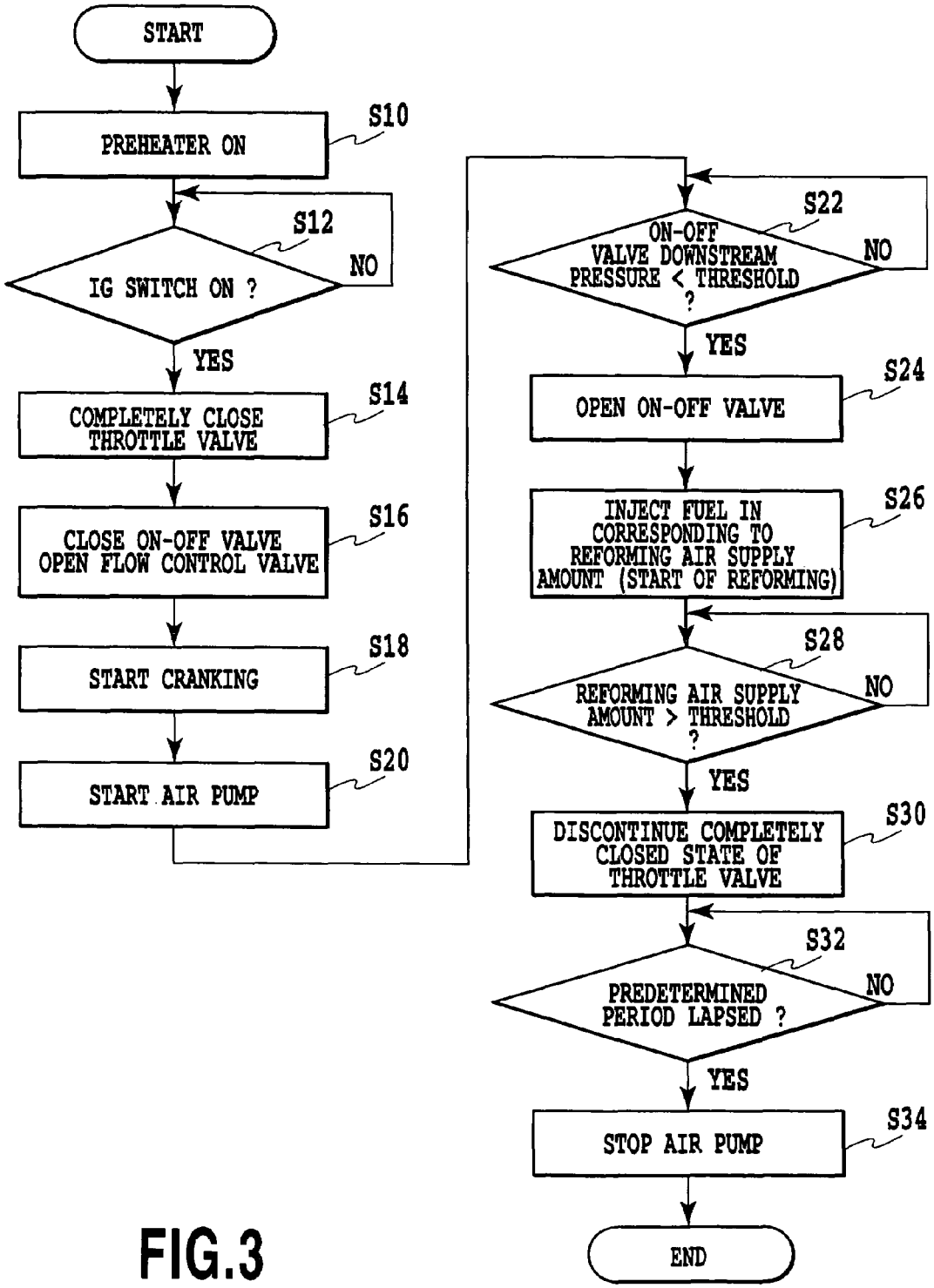
FIG. 3 is a flow chart for explaining an operation at a start-up of the internal combustion engine of FIG. 1.
Figure 4:
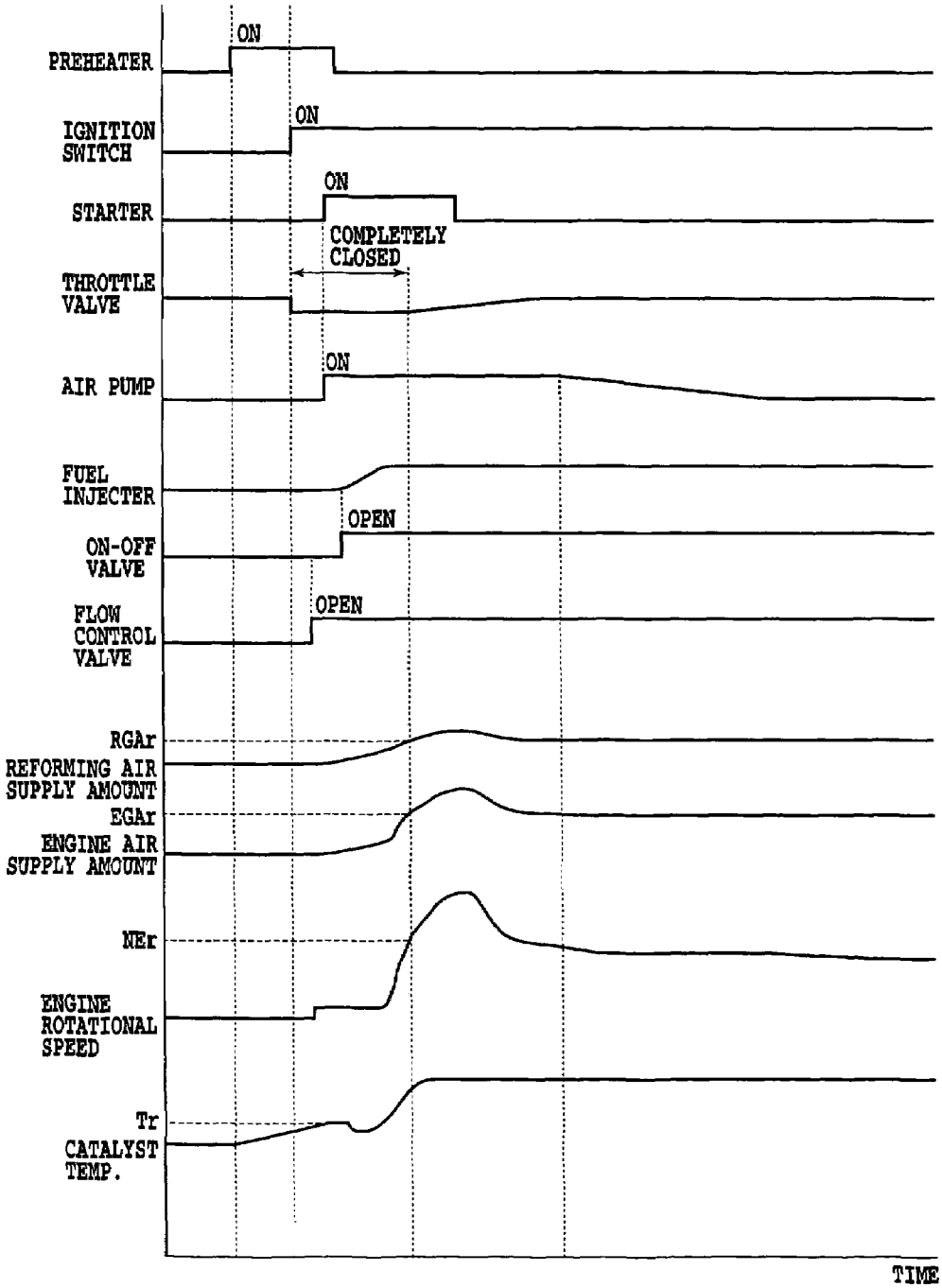
FIG. 4 is a timing chart for explaining the operation at the start-up of the internal combustion engine of FIG. 1.

In view of the foregoing, the internal combustion engine 1 (and the reformer 20) is made to start by the ECU 30 (control means) in accordance with a procedure shown in FIGS. 3 and 4.

Upon starting the internal combustion engine 1, the ECU 30 initially makes the preheater 24 of the reformer 20 operate if it determines that the door of the vehicle is opened based on the signal from the door switch 31 (S10). Thus, catalyst temperature (temperature of a catalyst floor) in the reforming reaction section 23 of the reformer 20 gradually rises. In addition, after the operation of the preheater 24 has started, the ECU 30 obtains the catalyst temperature based on the signal from the temperature sensor ST. Then, the ECU 30 stops the operation of the preheater 24 when the catalyst temperature in the reforming reaction section 23 reaches a predetermined value Tr (see FIG. 4). After making the preheater 24 operate at S10, the ECU 30 determines whether or not the ignition switch 32 is on (S12). If the ignition switch 32 is on, the ECU 30 sets an opening degree of the throttle valve 12 in the air supply pipe L1 at a minimum, which has been maintained at a slightly opened state until now (S14).

In the internal combustion engine 1 in this embodiment, to prevent a valve element (valve disc) of the throttle valve 12 from adhering to (engaging in) a inner surface of the air supply pipe (air intake line) L1, the throttle valve 12 is maintained at a certain opening degree (at a slightly opened state) even if the engine 1 is stationary as described above. Therefore, a sufficient amount of air may not be supplied to the reformer 20, if an air flow reaching the combustion chambers 3 via the slightly opening throttle valve 12 is formed within the air supply pipe L1 when air is supplied to the reformer 20 via the bypass pipe L2 for the purpose of the start-up of the internal combustion engine 1. In view of such a point, according to the internal combustion engine 1 of this embodiment, the opening degree of the throttle valve 12 is set at a minimum at S14 prior to the start of the supply of air to the reformer 20, that is, the start of the fuel reforming operation in the reformer 20.

Further, the ECU 30 maintains the on-off valve 15 of the bypass pipe L2 in a closed state (or makes the on-off valve 15 close if it is in an open state), and makes the flow control valve 14 of the bypass pipe L2 open up to a predetermined opening degree (S16). That is, at S16, the opening degree of the flow control valve 14 is presets at a value required at a time when the fuel reforming operation in the reformer 20 is started while the on-off valve 15 is closed to interrupt the flow of air into the reformer 20.

By setting the opening degree of the flow control valve 14 while the on-off valve 15 is closed (prior to opening the on-off valve 15), it is possible to precisely set an amount of air supplied to the reformer 20 to start the fuel reforming operation immediately following the opening of the on-off valve 15. Thus, it is possible to obtain a desired amount of the reformed fuel by the stable and favorable fuel reforming operation. In addition, the setting of the opening degree of the flow control valve 14 at S16 is executed in accordance with a map prepared in advance to define the relationship between an target torque or a rotational speed and an amount of air to be supplied to the reformer 20 (an amount of reforming air) during an idling (for example).

After the process of S16, the ECU 30 starts a cranking of the internal combustion engine 1 by making the starter 19 operate for a predetermined time (S18), and simultaneously therewith, makes the air pump AP of the bypass pipe L2 start (S20). Then, the ECU 30 obtains a pressure on the downstream side of the on-off valve 15 (an internal pressure of the reformer 20) based on the signal from the pressure sensor SP of the surge tank 10 and compares the obtained pressure with a predetermined threshold value (S22). If it is determined that the pressure obtained based on the signal from the pressure sensor SP at S22 is lower than the threshold value, the ECU 30 makes the on-off valve 15 of the bypass pipe L2 open to start the supply of air to the reformer 20 (S24). Further, almost simultaneously with the process at S24, the ECU 30 controls the fuel injection valve 16 so that the fuel is injected into the air-fuel mixing section 22 by an amount corresponding to an amount of air supplied to the reformer 20 via the bypass pipe L2 (an amount of reforming air) to start the reforming operation in the reformer 20 (S26).

According to this embodiment, as described above, the air pump AP is made to start almost simultaneously with the start of the cranking at S18 after the opening degree of the throttle valve 12 is set at a minimum (S20). Thus, a negative pressure is generated in the respective combustion chambers 3 by the cranking of the internal combustion engine 1, and the pressure upstream of the on-off valve 15 becomes higher by starting the air pump AP. Accordingly, if it is determined that the pressure obtained based on the signal from the pressure sensor SP is lower than the threshold value at S22, a pressure at a predetermined position downstream of the on-off valve 15 (an internal pressure of the reformer 20) is lower than a pressure at a predetermined position upstream of the on-off valve 15 (for example, a pressure at a discharge port of the air pump AP).

That is, in the internal combustion engine 1, the on-off valve 15 is made to open when the pressure on the downstream side of the on-off valve 15 is sufficiently lowered while the on-off valve 15 of the bypass pipe L2 is closed so that the pressure at the predetermined position downstream of the on-off valve 15 becomes lower than the pressure at the predetermined position upstream of the on-off valve 15. Further, in the internal combustion engine 1, the opening degree of the throttle valve 12 is set at a minimum (S14). Therefore, the supply of air to the reformer 20 is made to start for the fuel reforming operation in the reformer 20 while the air flow to the combustion chambers 3 via the throttle valve 12 is substantially interrupted (S24).

Accordingly, in the internal combustion engine 1, a sufficient amount of air supplied to the reformer 20 is ensured immediately following the start of the fuel reforming operation in the reformer 20. Thus, it is possible to favorably perform the fuel reforming operation in a stable manner and obtain a desired amount of reformed fuel. As a result, it is possible to smoothly start the internal combustion engine 1 by using the reformed fuel produced in the reformer 20. Also, in the internal combustion engine 1, since the air flow into the reforming reaction section 23 is interrupted from the beginning of the preheating of the reforming catalyst by the preheater 24 at S10 until the opening of the on-off valve 15 at S24, the reforming catalyst is completely prevented from being cooled by air flowing into the reformer 20.

When the fuel reforming operation starts in the reformer 20 at S26, the ECU 30 obtains a flow rate of air flowing through the bypass pipe L2, i.e., an amount of air supplied to the reformer 20 (reforming air supply amount), based on the signal from the second air flow meter AFM2 of the bypass pipe L2. Then, at S28, the ECU 30 compares the reforming air supply amount thus obtained with a predetermined threshold value RGAr (for example, a value larger than an amount of air capable of being supplied by the air pump AP when no sufficient negative pressure is generated in the combustion chamber 3 or the interior of the reformer 20). If the ECU 30 determined that the reforming air supply amount exceeds the threshold vale RGAr at S28, the ECU 30 discontinues the completely closed state of the throttle valve 12 in which the opening degree of the throttle valve 12 is minimum (S30).

If the amount of air supplied to the reformer 20 (the reforming air supply amount) exceeds the threshold value RGAr, the reforming reaction in the reformer 20 is stable and an amount of air to be sucked into the respective combustion chambers 3 of the internal combustion engine 1 also increases as seen from FIG. 4. Accordingly, even if the completely closed state of the throttle valve 12 in the air supply pipe L1 is discontinued and the adjustment of the opening degree of the throttle valve 12 is started to obtain the amount of air and the air-fuel ratio required for the internal combustion engine 1, the amount of air to be supplied to the reformer 20 is sufficiently ensured.

When it is determined that the reforming air supply amount exceeds the threshold value RGAr at S28, a sufficient amount of reformed fuel is supplied to the respective combustion chambers 3 from the reformer 20 and a much amount of air is also supplied to the respective combustion chambers 3, so that the internal combustion engine 1 is completely started. Thus, the ECU 30 discontinues the completely closed state of the throttle valve 12 (S30) and determines at S32 whether or not a predetermined period has lapsed from the determination that the reforming air supply amount exceeds the threshold value RGAr (that the start-up of the internal combustion engine 1 has completed) at S28. If it is determined at S32 that the predetermined period has lapsed from the completion of the start-up of the internal combustion engine 1, the ECU 30 stops the air pump AP while gradually decreasing the rotational speed of the air pump as shown in FIG. 4 (S34).

As described above, in the internal combustion engine 1, when the fuel reforming operation is started in the reformer 20, the air pump AP is made to start by the ECU 30, so that the sufficient amount of air is supplied to the reformer 20. On the other hand, at a stage in which the reforming air supply amount exceeds the threshold value RGAr and it is recognized that the start-up of the internal combustion engine 1 is completed, the negative pressure in the respective combustion chambers 3 is sufficient for taking air into the reformer 20 without using the air pump AP for this purpose.

Accordingly, after it is determined at S28 that the start-up of the internal combustion engine has completed based on a parameter such as the reforming air supply amount, a sufficient amount of air to be supplied to the reformer 20 is ensured even if the air pump AP is made to stop. Thus, it is possible to save energy for unnecessarily driving the air pump AP as well as to prevent a deterioration of the air pump AP. When the air pump AP is completely made to stop at S34, the ECU 30 terminates the procedure of FIG. 3 (a start-up operation of the reformer 20), and starts the control of the internal combustion engine 1 (the reformer 20) during the idling or an off-idling.

The process at S22 for determining whether or not the on-off valve 15 should open may be carried out in the following manner. That is, at S22, a pressure may be detected at a predetermined position upstream of the on-off valve 15 (a pressure in the bypass pipe L2 between the air pump AP and the on-off valve 15), and compared with a predetermined threshold value. Then, the on-off valve 15 is made to open when the pressure exceeds the threshold value. At S22, it may be determined whether or not a predetermined period has lapsed after the start of the cranking, and the on-off valve 15 may open at a time when the predetermined period has lapsed after the start of the cranking. Further, it may be determined at S22 whether or not a crank shaft of the engine 1 rotates by a predetermined number (for example, three times), and the on-off valve 15 may be made to open at a time when the crank shaft makes the predetermined number of rotation. Also, at S22, it may be determined whether or not a predetermined period has lapsed after the start of the air pump AP, and the on-off valve 15 may be made to open at a time when a predetermined period has lapsed after the start of the air pump AP.

The process at S28 for determining whether or not the completely closed state of the throttle valve 12 should be discontinued and the start-up of the engine 1 is completed may be carried out as follows. That is, at S28, the detected value of the first air flow meter AFM1 (a total amount of air supplied to all the combustion chambers 3) may be compared with a predetermined threshold value EGAr. In such a case, when the detected value of the first air flow meter AFM1 exceeds the threshold value EGAr, the completely closed state of the throttle valve 12 is discontinued and it is determined that the start-up of the engine 1 has completed. Also, at S28, the engine rotational speed obtained from the detected value of the crank angle sensor 34 may be compared with a predetermined threshold value NEr. In such a case, when the engine rotational speed exceeds the threshold value NEr, the completely closed state of the throttle valve 12 is discontinued and it is determined that the start-up of the engine 1 has completed.

Further, in this embodiment, the air pump AP is gradually made to stop at a time when a predetermined period has lapsed after it is determined that the start-up of the internal combustion engine 1 has completed at S28, for the purpose of preventing the operational state of the internal combustion engine 1 from being unstable. However, the present invention is not limited to this. That is, the air pump AP may be completely made to stop at a time when a predetermined period has lapsed after it is determined at S28 that the start-up of the internal combustion engine 1 has completed. Also, the air pump AP may be completely made to stop at a time when it is determined that the start-up of the internal combustion engine 1 has completed, or to gradually stop while decelerating the rotational speed from that time.

(Second Embodiment)

Figure 5:
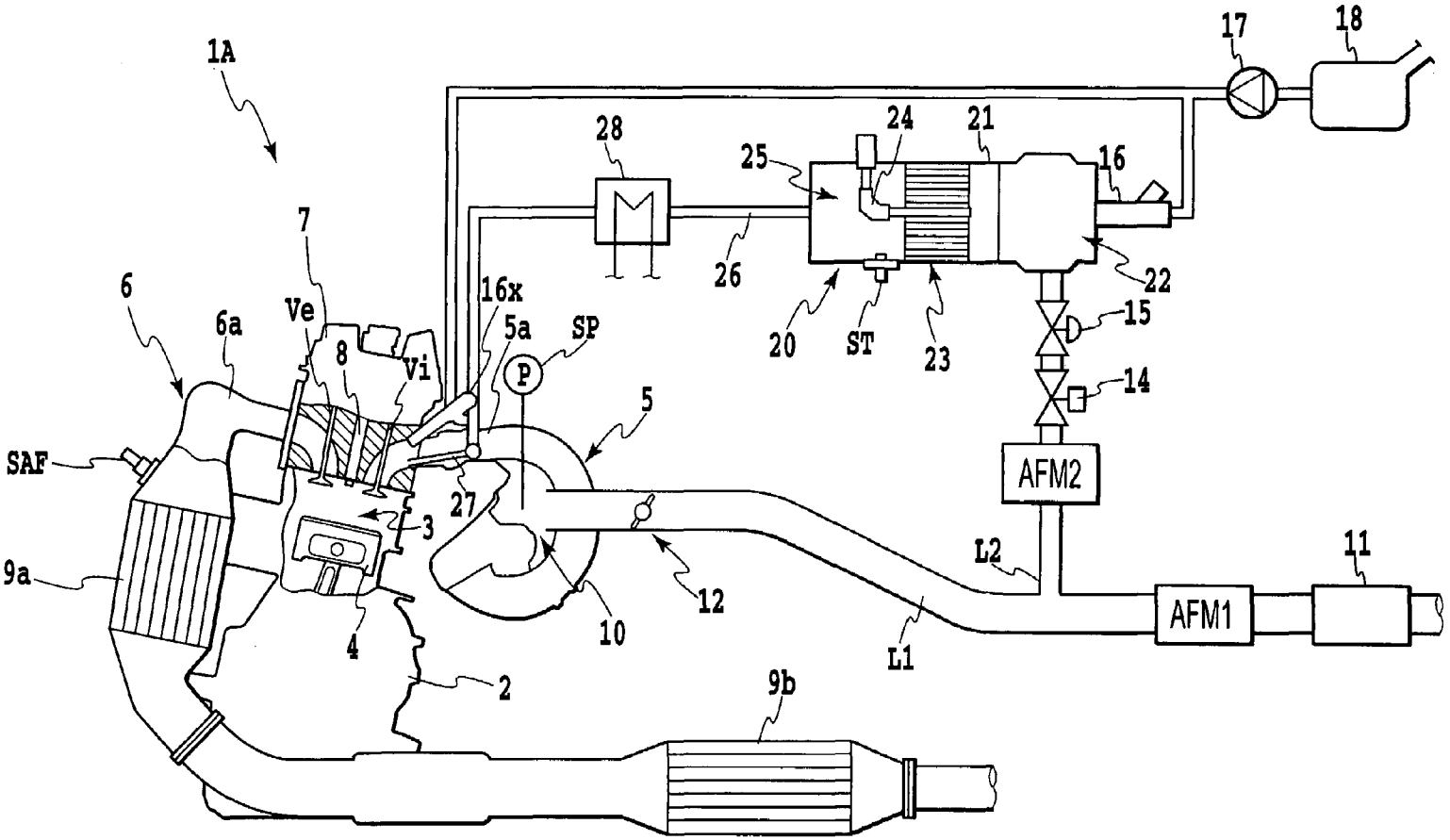
FIG. 5 is a schematic illustration of an internal combustion engine according to a second embodiment of the present invention.

A second embodiment of the present invention will be described below with reference to FIGS. 5 and 6. The same elements as those described with reference to the first embodiment are referred to same reference numerals and same description will be omitted.

Figure 6:
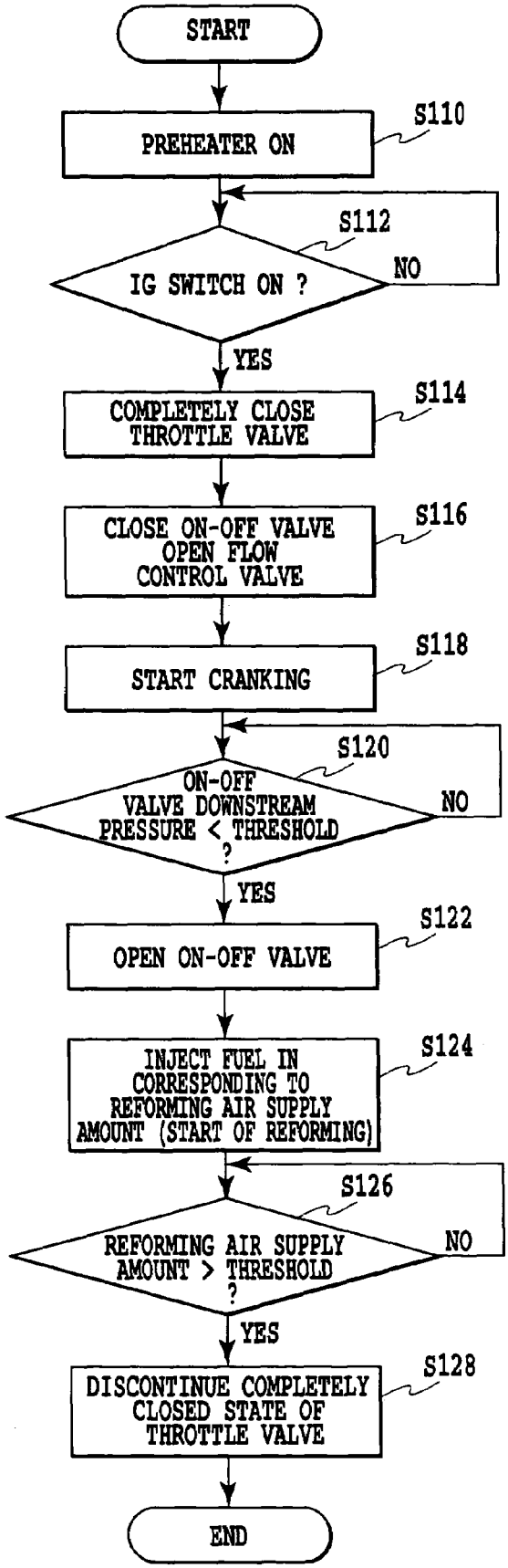
FIG. 6 is a flow chart for explaining an operation at a start-up of the internal combustion engine of FIG. 5.

The internal combustion engine 1A according to the second embodiment corresponds to the internal combustion engine 1 of FIG. 1, wherein the air pump AP is omitted from the bypass pipe L2 and engine 1A is made to start by the ECU 30 in accordance with a procedure of FIG. 6. Also in this embodiment, the ECU 30 first makes the preheater 24 of the reformer 20 operate (S110) and determines whether or not the ignition switch 32 is on (S112). If the ECU 30 determines that the ignition switch is on at S112, the opening degree of the throttle valve 12 in the air supply pipe L1 which has been slightly opened is minimized (S114). Thus, air flowing into the combustion chambers 3 via the throttle valve 12 is almost interrupted in the interior of the air supply pipe (air intake line) L1. Further, the ECU 30 maintains the on-off valve 15 of the bypass pipe L2 in a closed state and presets the opening degree of the flow control valve 14 of the bypass pipe L2 at a value required at the beginning of the fuel reforming operation (S116).

After the process at S116, the ECU 30 makes the starter 19 operate to start the cranking of the internal combustion engine 1A (S118). Then, the ECU 30 obtains a pressure on the downstream side of the on-off valve 15 (the internal pressure of the reformer 20) based on the signal from the pressure sensor SP provided in the surge tank 10, and compares the pressure thus obtained with a predetermined threshold value (S120). If the ECU 30 determines that the pressure obtained based on the signal of the pressure sensor SP at S120 is lower than the threshold value, the ECU 30 makes the on-off valve 15 of the bypass pipe L2 open to start the supply of air to the reformer 20 (S122). Further, almost simultaneously with the process at S122, the ECU 30 controls the fuel injection valve 16 so that the fuel is injected into the air-mixing section 22 by an amount corresponding to an amount of air supplied to the reformer 20 via the bypass pipe L2 (the reforming air supply amount) to start the fuel reforming operation in the reformer 20. (S124).

In this embodiment, as described above, the cranking is made to start after the opening degree of the throttle valve 12 is set at a minimum (S118). Accordingly, the negative pressure is formed in the respective combustion chambers 3 by the cranking of the internal combustion engine 1A. Thus, a pressure at a predetermined position downstream of the on-off valve 15 (an internal pressure in the reformer 20) becomes lower than a pressure at a predetermined position upstream of the on-off valve 15 (for example, a pressure at an outlet of the flow control valve 14) if it is determined that the pressure obtained based on the signal from the pressure sensor SP is lower than the threshold value.

That is, in the internal combustion engine 1A, the on-off valve 15 is made to open when the pressure in the bypass pipe L2 on the downstream side of the on-off valve 15 (the internal pressure of the reformer 20) is sufficiently lowered while the on-off valve 15 of the bypass pipe L2 is closed so that the pressure at the predetermined position downstream of the on-off valve 15 becomes lower than the pressure at the predetermined position upstream of the on-off valve 15. Further, in the internal combustion engine 1A, the air supply to the reformer 20 is made to start (S122) and the fuel reforming operation is made to start in the reformer 20 (S124) under the condition in which the opening degree of the throttle valve 12 is set at a minimum at S114 and the air flow to the reformer 20 via the throttle valve 12 is substantially interrupted.

Accordingly, also in the internal combustion engine 1A having no air pump SP, a sufficient amount of air supplied to the reformer 20 is ensured immediately following the start of the fuel reforming operation in the reformer 20. Thus, it is possible to perform the fuel reforming operation in a stable manner to obtain a desired amount of reformed fuel. As a result, it is possible to smoothly start the internal combustion engine 1A by using the reformed fuel produced in the reformer 20. Also, in the internal combustion engine 1A, since the air supply to the reforming reaction section 23 is interrupted from the beginning of the preheating of the reforming catalyst by the preheater 24 at S110 until opening the on-off valve 15 at S122, the reforming catalyst can be completely prevented from being cooled by air flowing into the reformer 20.

When the fuel reforming operation is started in the reformer 20 at S124, the ECU 30 obtains a flow rate of air flowing through the bypass pipe L2 (a reforming air supply amount) based on the signal from the second air flow meter AFM2, and compares the reforming air supply amount thus obtained with a predetermined threshold value (S126). If it is determined that the reforming air supply amount thus obtained exceeds the threshold value, the ECU 30 discontinues the completely closed state of the throttle valve 12 in which the opening degree of the throttle valve 12 is minimum (S128).

Also in this embodiment, if the amount of air supplied to the reformer 20 (the reforming air supply amount) exceeds the threshold value, the reforming reaction in the reformer 20 is stable and an amount of air sucked into the respective combustion chambers 3 of the internal combustion engine 1A is increased. Accordingly, even if the completely closed state of the throttle valve 12 in the air supply pipe L1 is discontinued and the adjustment of the opening degree of the throttle valve 12 is started to obtain the amount of air and the air-fuel ratio required for the internal combustion engine 1A, the amount of air to be supplied to the reformer 20 is sufficiently ensured. When the completely closed state of the throttle valve 12 is discontinued at S128, the ECU 30 terminates the procedure of FIG. 6 and starts the control of the internal combustion engine 1A (the reformer 20) during the idling or the off-idling.

(Third Embodiment)

A third embodiment of the present invention will be described below with reference to FIG. 7. The same elements as those described with reference to the first and second embodiment are referred to same reference numerals and same description will be omitted.

The third embodiment of the present invention relates to a hybrid power system constituted by combining the internal combustion engine 1A of the second embodiment with an electric motor. In this embodiment, the crank shaft of the internal combustion engine 1A is coupled to two motor-generators (an AC synchronous motor operable as both of a motor and a generator) via a damper, a planetary gear train and the like. One of the two motor-generators is mainly used as a drive source and the other is driven by the internal combustion engine 1A and mainly serves as a generator. The hybrid power system includes a hybrid ECU for controlling the whole of the system, an engine ECU for controlling the internal combustion engine 1A and a motor ECU for controlling the respective motor-generators.

Figure 7:
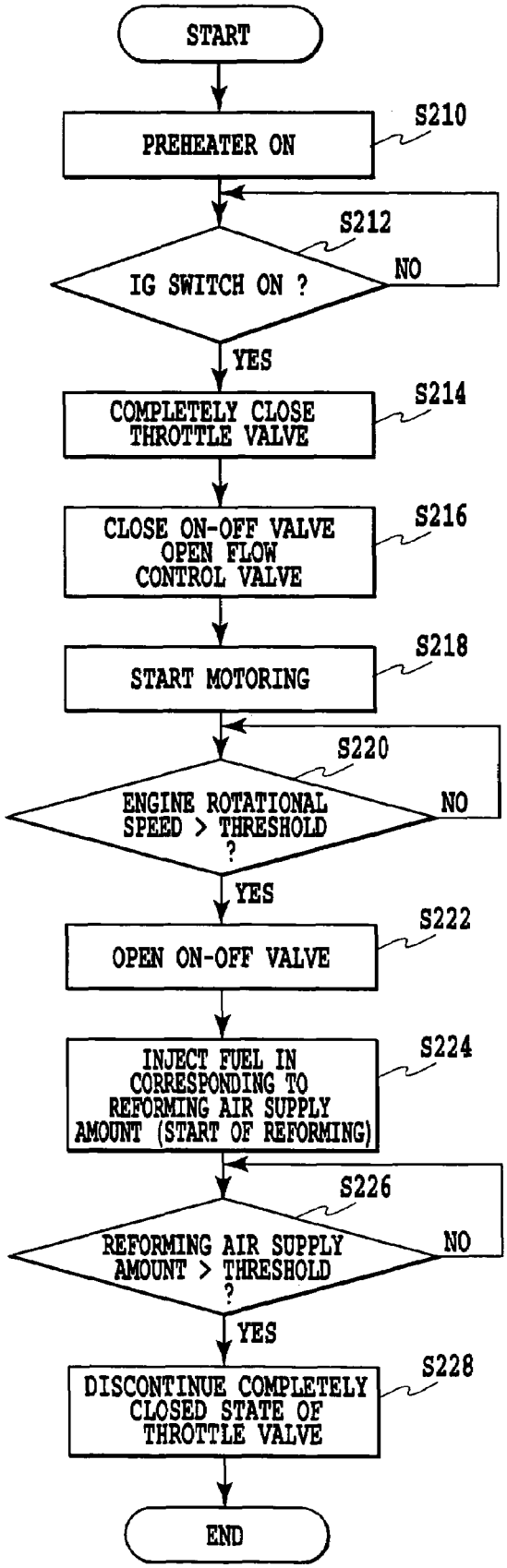
FIG. 7 is a flow chart for explaining an operation at a start-up of the internal combustion engine according to a third embodiment of the present invention.

FIG. 7 is a flow chart for explaining the start-up operation of the internal combustion engine 1A according to the third embodiment of the present invention. When the internal combustion engine 1A included in the hybrid power system of the third embodiment, the engine ECU first makes the preheater 24 in the reformer 20 operate (S210), and then determines whether or not the ignition switch 32 is switched on based on a signal from the hybrid ECU (S212). If it is determined that the ignition switch is on at S212, the opening degree of the throttle valve 12 in the air supply pipe L1 is set at a minimum by the engine ECU, which has been maintained in a slightly opened state (S214). Further, the on-off valve 15 of the bypass pipe L2 is maintained in a closed state and the opening degree of the flow control valve 14 of the bypass pipe L2 is preset to a value required at the beginning of the fuel reforming operation by the engine ECU (S216).

After completing the process at S216, the engine ECU provides the motor ECU via the hybrid ECU with a predetermined command signal. The motor ECU receiving the command signal from the engine ECU controls an inverter for the motor-generator in accordance with a predetermined program or others so that the crank shaft of the internal combustion engine 1A is made to rotate by either one of the motor-generators. As a result, the motoring of the internal combustion 1A engine is made to start (S218). Further, after the start of the motoring of the internal combustion engine 1A, the engine ECU obtains the engine rotational speed based on the signal from the crank angle sensor 34 and compares the engine rotational speed thus obtained with a predetermined threshold value (S220).

At S220, if it is determined that the engine rotational speed exceeds the threshold value, the engine ECU makes the on-off valve 15 of the bypass pipe L2 open to start the supply of air to the reformer 20 (S222). Further, almost simultaneously with the process at S222, the engine ECU controls the fuel injection valve 16 so that the fuel is injected into the air-mixing section 22 by an amount of corresponding to an amount of air supplied to the reformer 20 via the bypass pipe L2 (reforming air supply amount) to start the fuel reforming operation in the reformer 20 (S224).

In this embodiment, after the opening degree of the throttle valve 12 has been set at a minimum at S214, the cranking of the internal combustion engine 1A is started by the motor-generator as described above (S218). Accordingly, if it is determined that a negative pressure is generated in the respective combustion chambers 3 due to the motoring of the internal combustion engine 1A and the engine rotational speed exceeds a predetermined threshold value at S220, a pressure at a predetermined position downstream of the on-off valve 15 (the internal pressure in the reformer 20) becomes lower than a pressure at a predetermined position upstream of the on-off valve 15 (for example, the pressure at the outlet of the flow control valve 14).

That is, also in the internal combustion engine 1A included in the hybrid power system according to this embodiment, when the pressure downstream of the on-off valve 15 (the internal pressure of the reformer 20) is sufficiently lowered while the on-off valve 15 of the bypass pipe L2 is closed so that the pressure at the predetermined position downstream of the on-off valve 15 becomes lower than the pressure at the predetermined position upstream of the on-off valve 15, the on-off valve 15 is made to open. Further, in this embodiment, the supply of air to the reformer 20 is made to start (S222) under the condition in which the opening degree of the throttle valve 12 is set at a minimum at S214 to almost completely interrupt the air flow to the combustion chambers 3 via the throttle valve 12, and the fuel reforming operation is made to start in the reformer 20 (S224).

Accordingly, also in this embodiment, it is possible to ensure a sufficient amount of air to be supplied to the reformer 20 immediately following the start of the fuel reforming operation in the reformer 20. Thus, it is possible to perform the fuel reforming operation in a stable manner so as to obtain a desired amount of reformed fuel. As a result, the internal combustion engine 1A in the hybrid power system can be smoothly started by using the reformed fuel produced in the reformer 20. Also, in this embodiment, since air flowing into the reforming reaction section 23 is interrupted from the beginning of the preheating of the reforming catalyst by the preheater 24 at S210 to the opening of the on-off valve 15 at S222, the reforming catalyst can be completely prevented from being cooled by the air flow into the reformer 20.

When the fuel reforming operation of the reformer 20 starts at S224, the engine ECU obtains a flow rate of air flowing through the bypass pipe L2 (the reforming air supply amount) based on the signal from the second air flow meter AFM2 in the bypass pipe L2, and compares the reforming air supply amount thus obtained with a predetermined threshold value (S226). If it is determined that the reforming air supply amount exceeds the threshold value and the amount of air flowing into the reformer 20 reaches a predetermined value, the engine ECU discontinues the completely closed state of the throttle valve 12 in which the opening degree thereof is minimum (S228).

Also in this embodiment, if an amount of air flowing into the reformer 20 (a reforming air supply amount) exceeds the threshold value, the reforming reaction in the reformer 20 is stable and an amount of air sucked into the respective combustion chambers 3 is increased. Accordingly, even if the completely closed state of the throttle valve 12 in the air supply pipe L1 is discontinued and the adjustment of the opening degree of the throttle valve 12 is started to obtain the amount of air and the air-fuel ratio required for the internal combustion engine 1A is obtained, the amount of air to be supplied to the reformer 20 is sufficiently ensured. When the completely closed state of the throttle valve 12 is discontinued at S228, the engine ECU terminates the procedure of FIG. 7 (the start-up operation of the reformer), and then starts the control of the internal combustion engine 1A (the reformer 20) during the idling or the off-idling.

In addition, the motoring of the internal combustion engine 1A by the motor-generator is terminated at a predetermined timing. Further, instead of the internal combustion engine 1A, the internal combustion engine 1 with the air pump AP may be combined with the electric motor to constitute a hybrid power system.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An internal combustion engine generating power by combustion of a fuel air mixture of a reformed fuel and air in a combustion chamber, comprising:

a reformer for producing said reformed fuel by reforming a fuel air mixture of a predetermined fuel and air;

a reforming air supply line for supplying atmospheric air to said reformer, the atmospheric air excluding exhaust gas exiting the internal combustion engine;

a valve provided in said reforming air supply line; and control means for making said valve open when a pressure at a predetermined position downstream of said valve is lower than a pressure at a predetermined position upstream of said valve.

2. An internal combustion engine of claim 1, wherein said control means makes said valve close prior to a start of a fuel reforming operation in said reformer, and makes said valve open when said pressure at said predetermined position downstream of said valve becomes lower than a predetermined value after a cranking.

3. An internal combustion engine of claim 1, further comprising a flow control valve provided in said reforming air supply line for adjusting an amount of air to be supplied to said reformer, wherein said control means starts a setting of an opening degree of said flow control valve prior to an opening of said valve in said reforming air supply line.

4. An internal combustion engine of claim 1, further comprising an air intake line connected to said combustion chamber and including a throttle valve, wherein said reforming air supply line is branched from said air intake line on an upstream side of said throttle valve, and wherein said control means starts a fuel reforming operation in said reformer after setting an opening degree of said throttle valve at a minimum.

5. An internal combustion engine of claim 1, wherein said internal combustion engine is combined with an electric motor to constitute a hybrid power system, and wherein said control means makes said valve close prior to a start of a fuel reforming operation in said reformer, and makes said valve open when said pressure at said predetermined position downstream of said valve becomes lower than a predetermined value after a motoring.

6. A method of controlling an internal combustion engine for generating power by combustion of a fuel air mixture of a reformed fuel and air in a combustion chamber, said internal combustion engine comprising a reformer for producing said reformed fuel by reforming a fuel air mixture of a predetermined fuel and air; a reforming air supply line connected to the reformer; and a valve provided in said reforming air supply line, the method comprising steps of:

(a) supplying atmospheric air through the reforming air supply line to said reformer, the atmospheric air excluding exhaust gas exiting the internal combustion engine; and (b) making said valve open, when a pressure of the atmospheric air at a predetermined position downstream of said valve is lower than a pressure of the atmospheric air at a predetermined position upstream of said valve, to supply the atmospheric air excluding the exhaust gas exiting the engine, to said reformer.

7. A method of claim 6, further comprising, prior to step (b), the steps of:

(c) making said valve close prior to a start of a fuel reforming operation in said reformer; and (d) performing a cranking of said internal combustion engine.

8. A method of claim 6, wherein said internal combustion engine further comprises a flow control valve provided in said reforming air supply line for adjusting an amount of air to be supplied to said reformer, said method further comprising, prior to step (b), the step of:

(e) starting a setting of an opening degree of said flow control valve.

9. A method of claim 6, wherein said internal combustion engine further comprises an air intake line connected to said combustion chamber and including a throttle valve, and wherein said reforming air supply line is branched from said air intake line on a downstream side of said throttle valve, said method further comprising the step of:

(f) setting an opening degree of said throttle valve at a minimum prior to a start of a fuel reforming operation in said reformer.

10. A method of claim 6, wherein said internal combustion engine is combined with an electric motor to constitute a hybrid power system, said method further comprising the steps of:

(g) making said valve close prior to a start of a fuel reforming operation in said reformer; and (h) performing a motoring to rotate a shaft of said internal combustion engine by said electric motor.

* * * * *